US008074771B2

(12) United States Patent
Nickelson

(10) Patent No.: US 8,074,771 B2
(45) Date of Patent: Dec. 13, 2011

(54) SAFETY LADDER

(76) Inventor: David A. Nickelson, Scandia, MN (US)

( * ) Notice: Subject to any disclaimer, the term of this patent is extended or adjusted under 35 U.S.C. 154(b) by 978 days.

(21) Appl. No.: 11/698,265

(22) Filed: Jan. 25, 2007

(65) Prior Publication Data

US 2007/0193833 A1 Aug. 23, 2007

Related U.S. Application Data

(60) Provisional application No. 60/762,376, filed on Jan. 25, 2006.

(51) Int. Cl.
*E06C 1/00* (2006.01)

(52) U.S. Cl. ..... 182/195; 182/156

(58) Field of Classification Search ..... 182/195–197, 182/156, 164

See application file for complete search history.

(56) References Cited

U.S. PATENT DOCUMENTS

| | | | | | |
|---|---|---|---|---|---|
| 124,541 | A | * | 3/1872 | Buttkereit | 182/195 |
| 396,552 | A | * | 1/1889 | Elsbury | 182/195 |
| 406,765 | A | * | 7/1889 | Parry | 182/195 |
| 674,584 | A | * | 5/1901 | Porter | 182/195 |
| 870,914 | A | * | 11/1907 | Twitchell | 248/448 |
| 994,760 | A | * | 6/1911 | Laroy | 182/207 |
| 2,043,304 | A | * | 6/1936 | Pfister | 248/464 |
| 2,534,202 | A | * | 12/1950 | McCall | 182/93 |
| 3,083,785 | A | * | 4/1963 | Hyman | 182/89 |
| 3,307,654 | A | * | 3/1967 | Green et al. | 182/198 |
| 4,541,507 | A | * | 9/1985 | Gibellato | 182/86 |
| 5,143,174 | A | | 9/1992 | Davis | |
| 5,738,186 | A | | 4/1998 | Jones | |
| 6,386,318 | B1 | * | 5/2002 | Smith | 182/97 |
| 6,530,455 | B1 | | 3/2003 | Arnette et al. | |
| 2003/0037991 | A1 | | 2/2003 | Dibelardino et al. | |
| 2004/0031646 | A1 | | 2/2004 | Huang | |

FOREIGN PATENT DOCUMENTS

| | | | |
|---|---|---|---|
| FR | 2552316 | A * | 3/1985 |

* cited by examiner

*Primary Examiner* — Alvin Chin Shue

(74) *Attorney, Agent, or Firm* — Nikolai & Mersereau P.A.; Thomas J. Nikolai

(57) ABSTRACT

Safety ladders to provide egress from water to a dock or boat or the like are disclosed. Safety ladders in accordance with the present invention are mountable to a structure, upwardly collapsible to a first storage configuration, and downwardly extendible to a second climbing configuration.

19 Claims, 6 Drawing Sheets

SAFETY LADDER

PRIORITY CLAIM

This application claims the benefit of U.S. Provisional Patent Application having Ser. No. 60/762,376 filed on Jan. 25, 2006, entitled "Safety Ladder", the entire disclosure of which is incorporated herein by reference for all purposes.

TECHNICAL FIELD

The present invention relates to safety ladders. More particularly, the present invention relates to safety ladders to provide egress from water to a dock or boat or the like.

SUMMARY

In one aspect of the present invention a safety ladder is provided that is mountable to a structure, upwardly collapsible to a first storage configuration, and downwardly extendible to a second climbing configuration. The safety ladder comprises a first link comprising a rung portion positioned between a first upwardly extending member and a second upwardly extending member. The first and second upwardly extending members each comprise an end for mounting the ladder to the structure. The safety ladder also comprises a second link comprising a rung portion positioned between a first upwardly extending member and a second upwardly extending member. The first upwardly extending member of the second link comprises an end with an eye portion slidingly connected with the first upwardly extending member of the first link. The second upwardly extending member of the second link also comprises an end with an eye portion slidingly connected with the second upwardly extending member of the first link. The ladder may comprise any number of additional similar links.

In another aspect of the present invention, a method of making a safety ladder that is mountable to a structure, upwardly collapsible to a first storage configuration, and downwardly extendible to a second climbing configuration is provided. The method comprises the steps of forming a first link by positioning a rung portion between first and second upwardly extending members, forming a second link by positioning a rung portion between first and second upwardly extending members, forming first and second eyes at first and second ends of the first and second upwardly extending members of the second link, respectively, and slidingly connecting the first and second eyes of the first and second ends of the first and second upwardly extending members of the second link with the first and second upwardly extending member of the first link, respectively.

In yet another aspect of the present invention, a method of providing a safety ladder on a structure such as a dock is provided. The method comprises the steps of providing a ladder as described above, attaching the first link of the ladder to a structure, sliding the first and second links relative to each other to provide the ladder in a collapsed configuration wherein the rung portion of the first link is closer to the rung portion of the second link as compared to when the ladder is in an extended climbing configuration, and releasably holding the ladder in the collapsed configuration.

BRIEF DESCRIPTION OF THE DRAWINGS

These and other features, aspects, and advantages of the present invention will become better understood with regard to the following description, appended claims, and accompanying drawings where:

DETAILED DESCRIPTION

Figure 1:
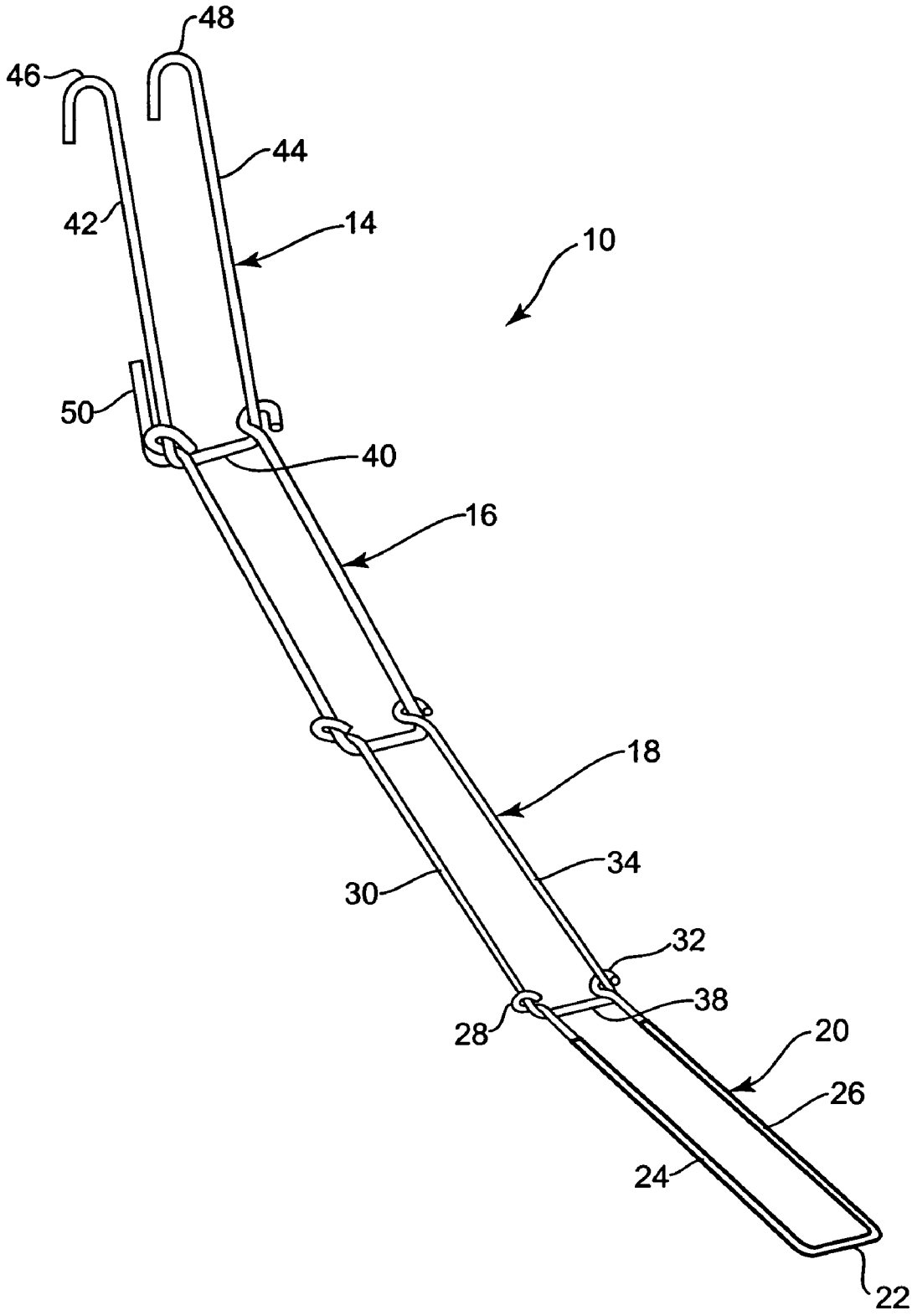
FIGS. 1 and 2 are perspective views of an exemplary ladder in accordance with the present invention showing in particular a plurality of slidably interconnected links positioned in an extended or climbing configuration of the ladder.
Figure 2:
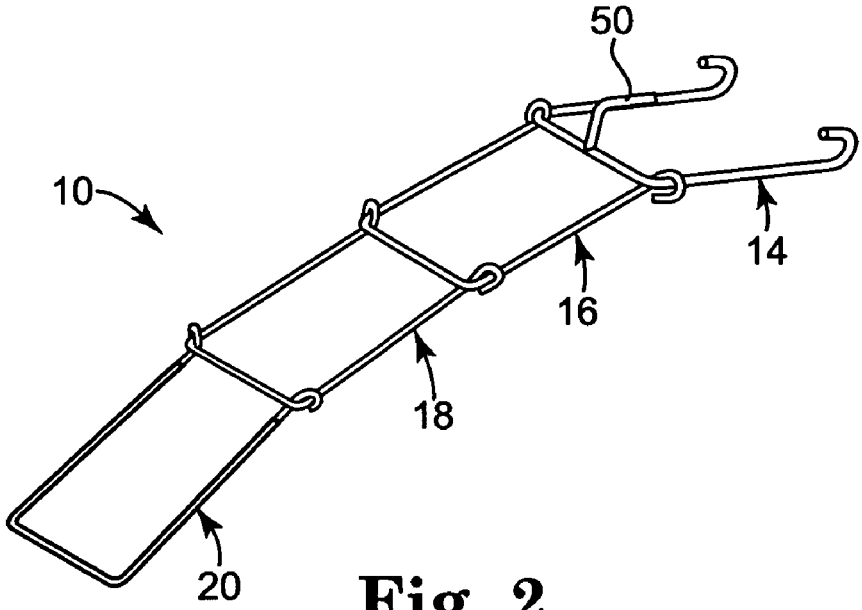
Figure 3:
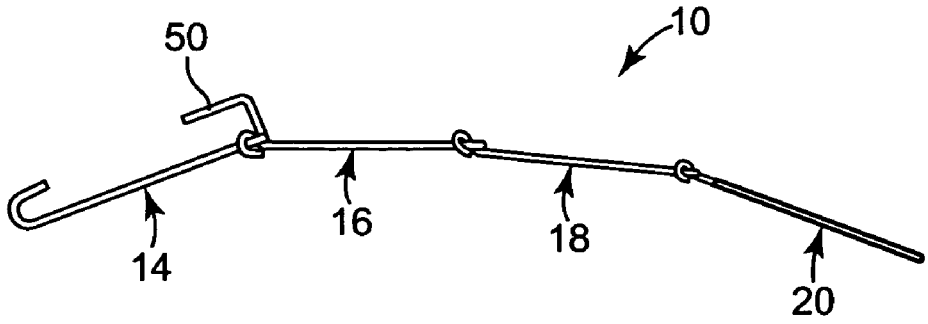
FIG. 3 is a side view of the ladder of FIGS. 1 and 2.
Figure 4:
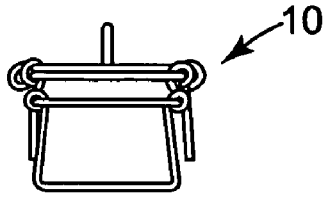
FIG. 4 is a top view of the ladder of FIGS. 1 and 2.
Figure 5:
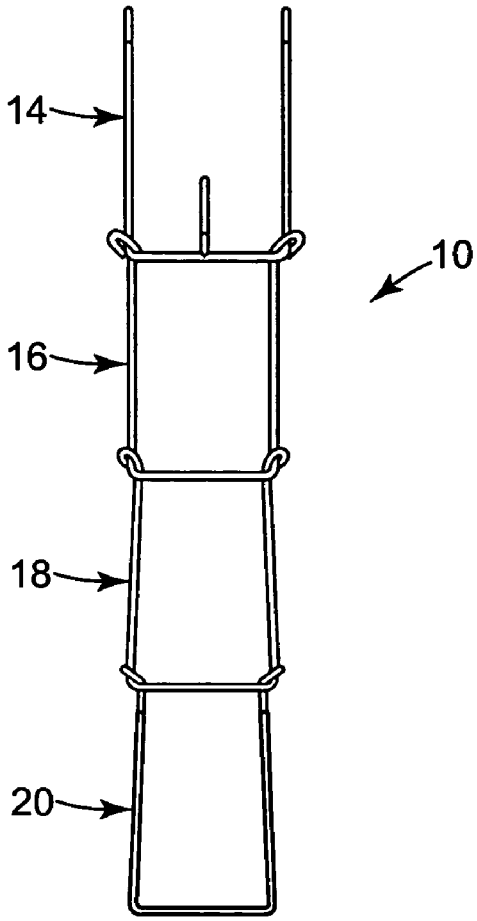
FIG. 5 is a front view of the ladder of FIGS. 1 and 2.
Figure 6:
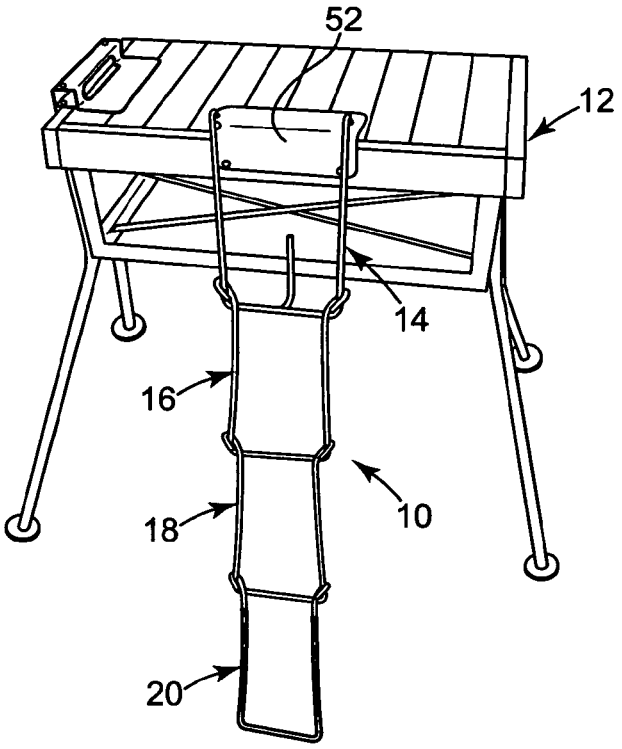
FIG. 6 is a front view of an exemplary ladder similar to the ladder of FIGS. 1-5 in accordance with the present invention shown attached to a structure and configured in an extended or climbing configuration.
Figure 7:
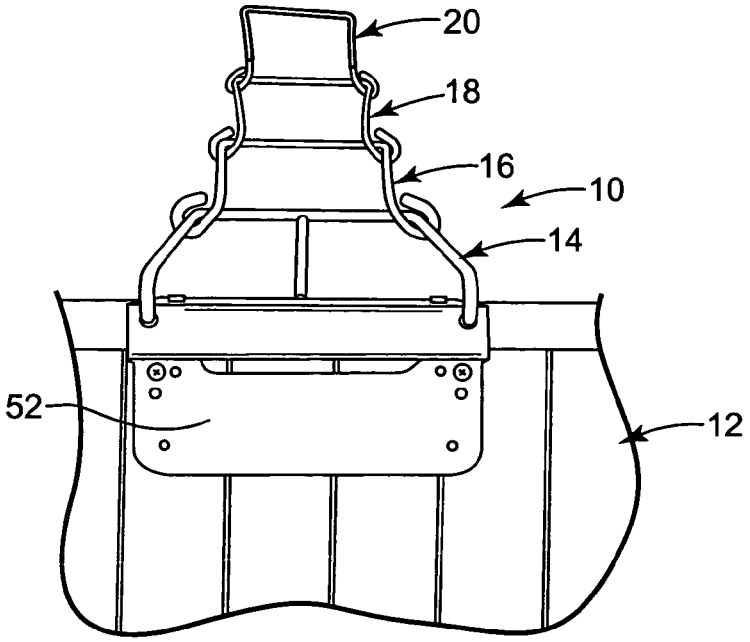
FIG. 7 is a top view of the ladder of FIG. 6.

In FIGS. 1-13 an exemplary safety ladder 10 in accordance with the present invention is illustrated. In FIG. 13, safety ladder 10 is shown mounted to a structure 12 (a portion of a dock, for example) and upwardly collapsed in a first storage configuration. In FIGS. 1-7 safety ladder 10 is shown downwardly extended to a second climbing configuration.

Referring to FIGS. 1-7, safety ladder 10 comprises slidingly interconnected links 14, 16, 18, and 20, as illustrated. Link 14 preferably functions to mount ladder 10 to structure 12 and is described in more detail below. Links 16, 18, and 20 function to provide climbing rungs for ladder 10 and are also interconnected in a way that allows links 16, 18, and 20 to be positioned relative to link 14 in the collapsed storage configuration shown in FIG. 13. Any number of links may be used depending on the desired application for ladder 10. The links are preferably designed with dimensions suitable for the particular application of the ladder.

Referring to link 20 in particular, link 20 is generally u-shaped and comprises a rung portion 22 positioned between first upwardly extending member 24 and second upwardly extending member 26. Eye 28 is provided at an end of first upwardly extending member 24 and slidingly engages first upwardly extending member 30 of link 18. Similarly, eye 32 is provided at an end of second upwardly extending member 26 and slidingly engages second upwardly extending member 34 of link 18. As shown, links 16 and 18 preferably have a structure similar to link 20 but may have a different structure.

Figure 8:
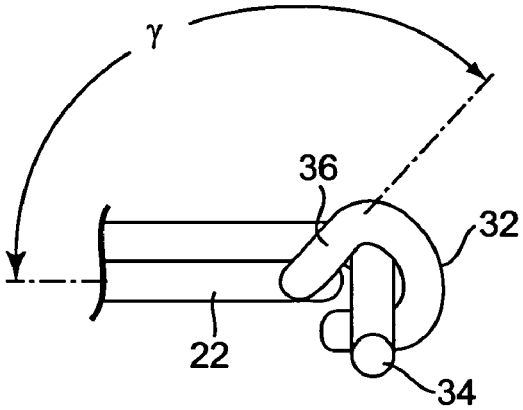
FIG. 8 is a partial top view of an eye at an end of an upwardly extending member of a first link as slidingly engaged with an upwardly extending member of a second link of a ladder in accordance with the present invention.
Figure 10:
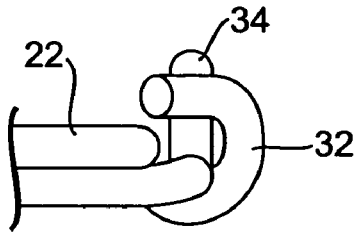
FIG. 10 is a partial bottom view of the engaged eye of FIG. 8.
Figure 9:
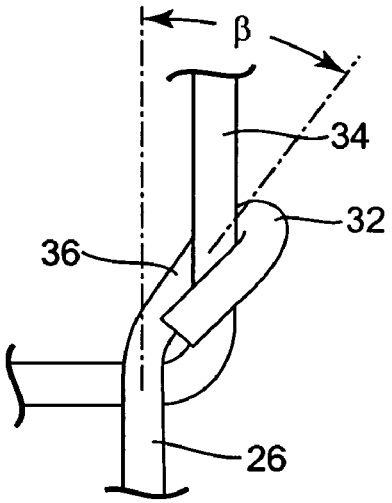
FIG. 9 is a partial front view of the engaged eye of FIG. 8.

Referring to FIGS. 8-11, eye 32 of link 20 is shown in greater detail and is representative of an eye that can be used for any link of ladder 10 in accordance of the present invention. In FIG. 9 a front view of eye 32 as engaged with member 34 is shown and in FIG. 11 a right side view is shown. FIGS. 8 and 10 show top and bottom views, respectively, with respect to the front view of FIG. 9. As illustrated, eye 32 is canted (angled or bent) relative to member 26. Specifically, eye 32 is preferably canted back and to the right with respect to member 26 as viewed from the front of ladder 10. As shown, eye 32 includes extending portion 36 that extends from member 26 and which can be used as a reference to define the preferred orientation of eye 32 with respect to member 26. While extending portion 26 is illustrated as linearly extending, it is noted that extending portion 36 can be arcuate or otherwise curved or looped.

Figure 11:
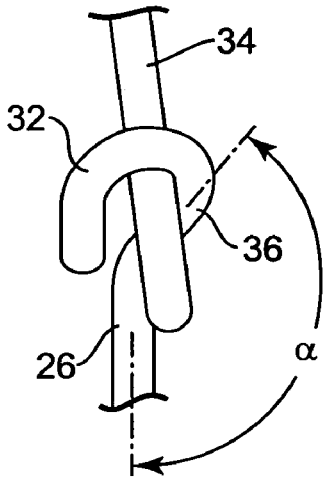
FIG. 11 is a partial side view of the engaged eye of FIG. 8.

As viewed from the side as shown in FIG. 11, extending portion 36 makes an angle a with member 26 and as viewed from the front as shown in FIG. 9, extending portion 36 makes an angle β with member 26. Also, as shown in FIG. 8, extending portion 36 makes an angle γ with rung 20 as viewed from the top. Thus, eye 32 is canted back and to the right with respect to member 26 when viewing ladder 10 from the front. Preferably the angle α is between about 90 to 160 degrees. Preferably the angle β is between about 0 to 90 degrees. Preferably the angle γ is between about 90 to 160 degrees. More preferably the angle α is between about 110 to 130 degrees. More preferably the angle β is between about 10 to 30 degrees. More preferably the angle γ is between about 110 to 130 degrees. One preferred ladder in accordance with the present invention has angles for α, β, and γ of about 120, 20, and 120 degrees, respectively. Angles α, β, and γ are preferably chosen so that eye 32 can functionally slide with respect to member 34 to position link 20 in the collapsed and extended configuration of ladder 10 in accordance with the present invention.

When ladder 10 is in the extended or climbing configuration, eye 32 (and eye 28) engages with rung 38 of link 18. This engagement is preferably balanced so each of eyes 28 and 32 acts like a lever to balance or stabilize a link. That is, preferably, the cant or bend of eye 28 is symmetric to eye 32. A similar engagement occurs with the other links of ladder 10. This engagement between the eyes and rungs of ladder 10 helps to prevent the links of ladder 10 from moving relative to each other in a direction away from someone climbing ladder 10 and helps to stabilize ladder 10. This engagement also helps provide rigidity and structural stability in a transverse or side to side direction.

Link 14, which can best be seen in FIG. 1 is preferably designed to mount ladder 10 to structure 12 as shown in FIGS. 6-13. As shown, link 14 includes a rung portion 40 positioned between first upwardly extending member 42 and second upwardly extending member 44. Hook portion 46 is provided at an end of first upwardly extending member 42 and hook portion 48 is provided at an end of second upwardly extending member 44. Link 14 also preferably includes a stabilization bar 50 that extends from rung portion 40.

Figure 12:
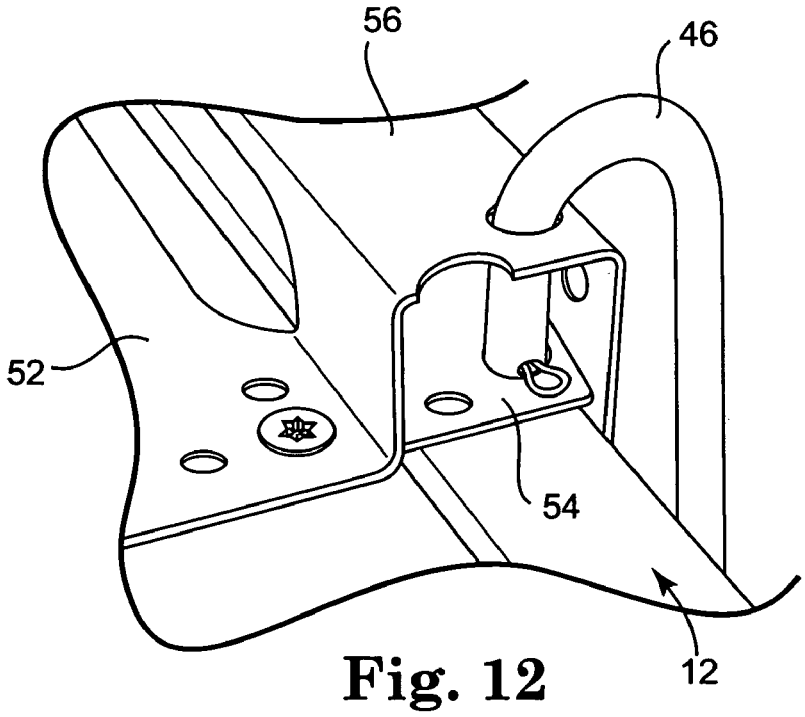
FIG. 12 is a partial perspective view of a mounting bracket in accordance with the present invention shown engaged with a hook portion of a mounting link of a ladder in accordance with the present invention.
Figure 13:
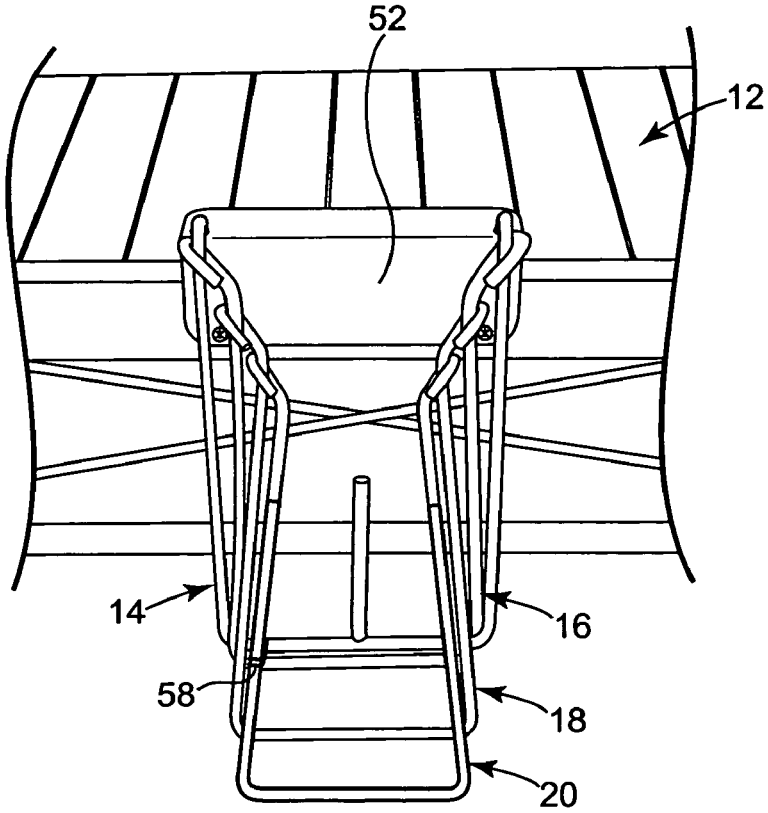
FIG. 13 is a perspective view of an exemplary ladder in accordance with the present invention shown in a collapsed or storage configuration.

Referring to FIG. 12 in particular, hook portion 46 of member 42 is shown as engaged with mounting bracket 52 secured to structure 12. Mounting bracket 52 includes spaced apart plate portions, 54 and 56, each having openings through which hook portion 46 can pass. As shown, a cotter pin is used to prevent hook portion 46 from separating from mounting bracket 52. Hook portion 48 is similarly engaged with mounting bracket 52.

Mounting bracket 52 is designed to be securely attached to structure 12 and to provide and easy way to install and remove ladder 10. As illustrated, mounting bracket 52 comprises a right angle bracket designed for attachment to a typical dock but can be designed for securing ladder 10 to any desired structure such as a pool, boat, or the like. The hook and bracket structure is preferred but any structure may be used to attach ladder 10 to a structure. Moreover, while a separate mounting bracket is illustrated, a mounting flange of other structure may be integrated with link 14 in accordance with the present invention. Preferably, stabilization bar 50 is designed to work together with mounting bracket 52 to help provide a secure mounting arrangement such as by providing a balancing or offsetting function.

Preferably, links 14, 16, 18, and 20 comprise monolithic structures. That is, each link is preferably formed, by bending for example, from a bar or the like. However, each link can be assembled from plural pieces such as by welding, mechanical fastening, or joining, or the like. An exemplary assembly process includes forming each desired link so that each eye is sufficiently open to allow the eye to pass over its respective upwardly extending member. A suitable tool can then be used to close the eye so that is slidingly attached to the upwardly extending member.

Preferred materials for fabricating the links of ladder 10 include aluminum, steel, and stainless steel, for example. Any material that provides the desired properties. such as formability, strength, and corrosion resistance, can be used. Preferably, ½ inch diameter round stock is used for links 14 and 16 while ⅜ inch diameter stock is used for links 18 and 20 (or any subsequent lower links). Generally, larger diameter stock is preferred for use on the links that are attached to or near the structure to which the ladder is attached (upper links). Lower links can be made from smaller diameter stock because these links do not need to be as strong/rigid as the upper links. That is, there is a larger bending force on the upper links when a person climbs the ladder.

In use, ladder 10 can be attached to a structure such as a dock or the like and provided in the collapsed configuration. Preferably, a releasably connection is used to hold ladder 10 in the collapsed configuration. Such a connection may include a wire 58, as shown in FIG. 13, clip, hook, breakable tie, or the like. The releasably connection functions to hold ladder 10 in the collapsed configuration until needed. That is, the releasably connection is preferably designed to release when someone such as a swimmer pulls on the lowermost rung of ladder 10 so that ladder 10 downwardly extends to the climbing configuration.

The present invention has now been described with reference to several embodiments thereof. The entire disclosure of any patent or patent application identified herein is hereby incorporated by reference. The foregoing detailed description and examples have been given for clarity of understanding only. No unnecessary limitations are to be understood therefrom. It will be apparent to those skilled in the art that many changes can be made in the embodiments described without departing from the scope of the invention. Thus, the scope of the present invention should not be limited to the structures described herein, but only by the structures described by the language of the claims and the equivalents of those structures.

What is claimed is:

1. A safety ladder that is mountable to a structure, upwardly collapsible to a first storage configuration, and downwardly extendible to a second climbing configuration, the safety ladder comprising:

a first link comprising a rung portion positioned between a first upwardly extending member having an end for mounting the ladder to the structure and a second upwardly extending member having an end for mounting the ladder to the structure; and a second link comprising a rung portion positioned between a first upwardly extending member and a second upwardly extending member, the first upwardly extending member of the second link having an end with an eye slidingly connected to the first upwardly extending member of the first link, the eye of the first upwardly extending member of the second link having an extending portion canted at a first angle relative to the first upwardly extending member of the second link as viewed from a first direction and canted at a second angle relative to the first upwardly extending member of the second link as viewed from a second direction orthogonal to the first direction, the second upwardly extending member of the second link having an end with an eye slidingly connected to the second upwardly extending member of the first link, the eye on the end of the second upwardly extending member of the second link also being canted relative to the second upwardly extending member of the second link, the first and second angles being such that a weight of a person ascending the ladder rigidly locks the first link to the second link, inhibiting movement of the ladder from a vertical orientation.

2. The ladder of claim 1, wherein the first and second upwardly extending members of at least one of the first and second links extend toward each other as the first and second upwardly extending members extend upward.

3. The ladder of claim 1, comprising at least one additional link similar to the second link.

4. The ladder of claim 3, wherein the second link comprises rod stock having a first diameter and the at least one additional link comprises rod stock having a second diameter different from the first diameter.

5. The ladder of claim 4, wherein the first diameter is greater than the second diameter.

6. The ladder of claim 1, in combination with a structure.

7. The ladder of claim 6, wherein the structure comprises a dock.

8. The ladder of claim 1, wherein the ladder comprises a front and right side and the view from the first direction comprises a front view of the ladder, wherein the extending portion of the eye of the first extending member of the second link is canted to the right as viewed from the first direction to provide the first angle.

9. The ladder of claim 8, wherein the first angle is between about 10 to 30 degrees.

10. The ladder of claim 1, wherein the ladder comprises a front and right side and the view from the first direction comprises a right side view of the ladder, wherein the extending portion of the eye of the first extending member of the second link is canted back away from the front of the ladder as viewed from the second direction to provide the second angle.

11. The ladder of claim 10, wherein the second angle is between about 110 to 130 degrees.

12. The ladder of claim 1, wherein the ladder comprises a front and left side and the view from the first direction comprises a front view of the ladder, wherein the extending portion of the eye of the second extending member of the second link is canted to the left as viewed from the first direction to provide the first angle.

13. The ladder of claim 12, wherein the first angle is between about 10 to 30 degrees.

14. The ladder of claim 1, wherein the ladder comprises a front and left side and the view form the second direction comprises a left side view of the ladder, wherein the extending portion of the eye of the second extending member of the second link is canted back away from the front of the ladder as viewed from the second direction to provide the second angle.

15. The ladder of claim 14, wherein the second angle is between about 110 to 130 degrees.

16. A safety ladder that is upwardly collapsible to a first storage configuration and downwardly extendible to a second climbing configuration, the safety ladder comprising:

a first link comprising a rung portion positioned between a first upwardly extending member and a second upwardly extending member; and a second link comprising a rung portion positioned between a first upwardly extending member and a second upwardly extending member, the first upwardly extending member of the second link having an end with an eye portion formed thereon and being slidingly connected to the first upwardly extending member of the first link, the second upwardly extending member of the second link having an eye portion formed thereon and being slidingly connected to the second upwardly extending member of the first link;

each of the eye portions of the second link is canted at a predetermined angle relative to the upwardly extending member on which it is formed; and wherein the first and second upwardly extending members of at least one of the first and second links extend toward each other as the first and second upwardly extending members extend upward, said predetermined angle being such that the ladder maintains a vertical orientation as a person ascends the ladder.

17. The ladder of claim 16, wherein the first upwardly extending member of the first link comprises an end for mounting the ladder to a structure and the second upwardly extending member of the first link comprises an end for mounting the ladder to the structure.

18. The ladder of claim 16, wherein the first upwardly extending member of the first link comprises an end slidingly connected to a third link and the second upwardly extending member of the first link comprises an end slidingly connected to the third link.

19. A safety ladder that is mountable to a structure, upwardly collapsible to a first storage configuration, downwardly extendible to a second climbing configuration, and having a front, left, and right side, the safety ladder comprising:

a first link comprising a rung portion positioned between a right upwardly extending member having an end for mounting the ladder to the structure and a left upwardly extending member having an end for mounting the ladder to the structure; and a second link comprising a rung portion positioned between a right upwardly extending member and a left upwardly extending member, the right upwardly extending member of the second link having an end with an eye slidingly connected to the right upwardly extending member of the first link, the eye of the right upwardly extending member of the second link having an extending portion canted at a first angle to the right and a second angle back away from the front of the ladder, the left upwardly extending member of the second link having an end with an eye slidingly connected to the left upwardly extending member of the first link, the eye of the left upwardly extending member of the second link having an extending portion canted to the left at said first angle and back away from the front of the ladder at said second angle, said first and second angles being such that the first and second links resist movement away from the vertical as a person ascends the ladder.

* * * * *

UNITED STATES PATENT AND TRADEMARK OFFICE

CERTIFICATE OF CORRECTION

PATENT NO. : 8,074,771 B2
APPLICATION NO. : 11/698265
DATED : December 13, 2011
INVENTOR(S) : David A. Nickelson It is certified that error appears in the above-identified patent and that said Letters Patent is hereby corrected as shown below:

In column 6, line 54, after the word "left", insert -- at said first angle --.

Signed and Sealed this
Fourteenth Day of February, 2012

David J. Kappos

David J. Kappos
*Director of the United States Patent and Trademark Office*

UNITED STATES PATENT AND TRADEMARK OFFICE

CERTIFICATE OF CORRECTION

PATENT NO. : 8,074,771 B2
APPLICATION NO. : 11/698265
DATED : December 13, 2011
INVENTOR(S) : David A. Nickelson It is certified that error appears in the above-identified patent and that said Letters Patent is hereby corrected as shown below:

This certificate supersedes the Certificate of Correction issued February 14, 2012. The certificate is vacated since the Certificate of Correction was requested in error by the applicant. The correction to Claim 19 (Original Claim 22) inserting the words "at said first angle" should never have been issued. The text "at said first angle" was deleted in amendment that was approved for entry by examiner. No new changes to Claim 19 (Original Claim 22) should have granted for this patent.

Signed and Sealed this
First Day of May, 2012

David J. Kappos

David J. Kappos
*Director of the United States Patent and Trademark Office*